United States Patent [19]

Jacobs

[11] 4,346,933

[45] Aug. 31, 1982

[54] RECLINING ACTUATOR FOR A RECLINER CHAIR

[75] Inventor: Ronald E. Jacobs, Georgetown, Ky.

[73] Assignee: Hoover Universal, Inc., Ann Arbor, Mich.

[21] Appl. No.: 147,192

[22] Filed: May 6, 1980

[51] Int. Cl.[3] ..... A47C 1/02

[52] U.S. Cl. ..... 297/89; 297/329; 297/DIG. 7

[58] Field of Search ..... 297/68, 88, 89, 83, 297/69, 317, 318, 322, 329, DIG. 7, 325, 326

[56] References Cited

U.S. PATENT DOCUMENTS

| | | | |
|---|---|---|---|
| 2,901,026 | 8/1959 | Thaden | 297/DIG. 7 |
| 3,743,349 | 7/1973 | Crum et al. | 297/317 X |
| 4,099,776 | 7/1978 | Crum et al. | 297/329 |

FOREIGN PATENT DOCUMENTS

| | | | |
|---|---|---|---|
| 799796 | 8/1958 | United Kingdom | 297/326 |

*Primary Examiner*—Peter P. Nerbun
*Attorney, Agent, or Firm*—Olsen and Stephenson

[57] ABSTRACT

An actuator assembly for a recliner chair having a chair frame, a seat unit, and a linkage mounting the seat unit on the chair frame for back and forth movement between a seating position and a reclining position located forwardly of the seating position. The actuator assembly includes a handle pivotally mounted on the side of the chair frame and connected through a link to an activator member which is pivotally mounted on the chair frame and provided with an abutting portion that is located in the path of movement of the seat unit. When the seat unit is in the seating position, a pivoting movement of the activator member in response to manipulation of the handle causes the abutting portion to engage the seat unit to move the seat unit forwardly toward its reclining position. The actuator assembly operates to move the seat unit only from the seating position toward its reclining position.

10 Claims, 4 Drawing Figures

RECLINING ACTUATOR FOR A RECLINER CHAIR

BACKGROUND OF THE INVENTION

The present invention relates generally to a recliner chair, and in particular, to a manually operated actuator assembly for effecting the reclining movement of the recliner chair.

Recliner chairs often are equipped with reclining actuators that are manually operable to cause a reclining movement of the reclining chair. The actuator assemblies are generally complex being structurally integrated with the linkage mechanism that supports the seat unit on the chair frame. Such recliner actuator assemblies are relatively difficult and expensive to install on a recliner chair and are hard to operate because they require high torque forces in order to move all the parts that must be moved in response to actuating handle movement.

It is the general object of this invention, therefore, to provide an improved reclining actuator assembly for a recliner chair that is simple to install, can be installed with any existing hardware, and is easy to operate because of the efficient utilization of operating forces.

CROSS REFERENCE TO RELATED APPLICATION

Application Ser. No. 100,951, filed Dec. 6, 1979 and assigned to the assignee of this invention, discloses a recliner chair like the chair in which the present invention is employed that utilizes an actuator handle that is incorporated as a part of the recliner hardware.

SUMMARY OF THE INVENTION

The present invention provides an improved reclining actuator assembly for a recliner chair which includes a chair frame, a seat unit, and a linkage mounting the seat unit on the chair frame for back and forth movement between an upright seating position and a reclining position located forwardly of the seating position. The recliner chair may also include a footrest connected by a scissors linkage to the recliner chair and movable between a concealed upright position in the seating position of the chair and an extended foot rest position in the reclining position of the chair.

U.S. Pat. No. 3,743,349 discloses a recliner chair hardware in which a handle that can move the chair both ways between upright and reclined positions is incorporated as a part of the recliner hardware. In the recliner chair to which the actuator of this invention is applied, the seat and back are fixedly mounted together and are connected to a chair frame by a linkage that allows the front of the seat to be moved forwardly and upwardly while the back is moved forwardly and downwardly during the reclining movement of the chair. A footrest is connected by a scissors linkage to the seat and chair frame and to the linkage connecting the seat to the chair frame so that it is extended in response to a reclining movement of the chair.

The reclining actuator assembly of the present invention includes a handle pivotally mounted on the side of the chair frame and connected through a link member to an activator member that is pivotally mounted on the rear of the chair frame. The activator member is pivotal in the longitudinal direction of the chair between an upright rest position and a forwardly inclined position in response to a corresponding pivotal movement of the handle between an idle position and an operative position. The actuator member includes an integral abutting portion located in the path of movement of the seat unit. When the seat is in the seating position, a movement of the handle from its idle position toward its operative position causes the activator member to be pivoted forwardly to engage the seat unit and move it toward its reclining position.

The activator member includes an integral stop extension that engages the chair frame to restrain a further forward movement of the activator member from its operative position so as to maintain the abutting portion in the path of movement of the seat unit. Consequently, a backward movement of the seat unit from its reclining position toward its seating position causes it to engage the abutting portion and return the activator member to its upright rest position and the handle to its idle position.

The actuator assembly of the present invention is operable only to move the seat unit from its seating position toward its reclining position through the engagement of the activator abutting portion with the seat unit. The seat unit must be returned to its seating position by the occupant grasping the arms of the chair and shifting his weight so as to effect the return movement of the seat to its upright seating position. The reclining actuator assembly of the present invention is simple, inexpensive, and highly effective to enable an occupant to easily move the seat to its reclining position.

Further objects, features and advantages of the present invention will become apparent from a consideration of the following description, the appended claims and the accompanying drawing in which:

Figure 1:
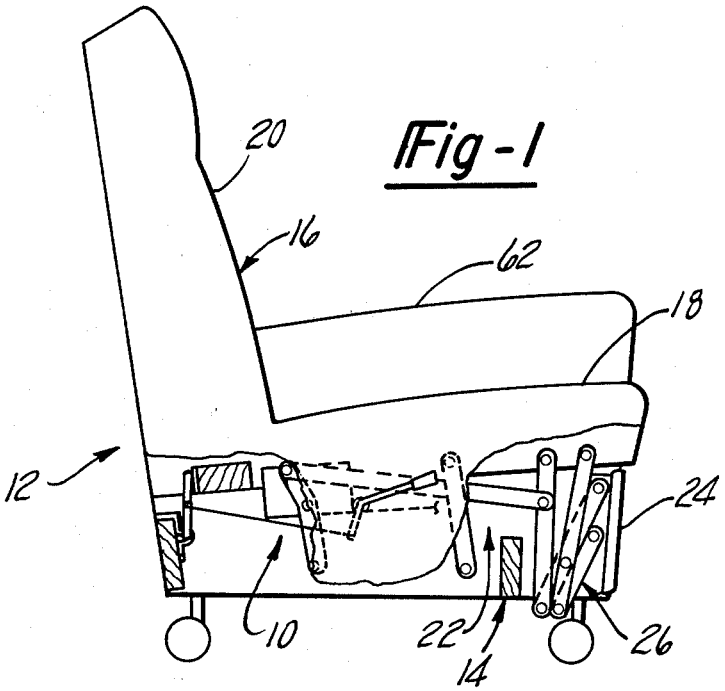
FIG. 1 is a side elevational view of a recliner chair in a seating position with portions broken away to illustrate the inner components of the recliner chair and to illustrate the recliner actuator assembly of the present invention.
Figure 2:
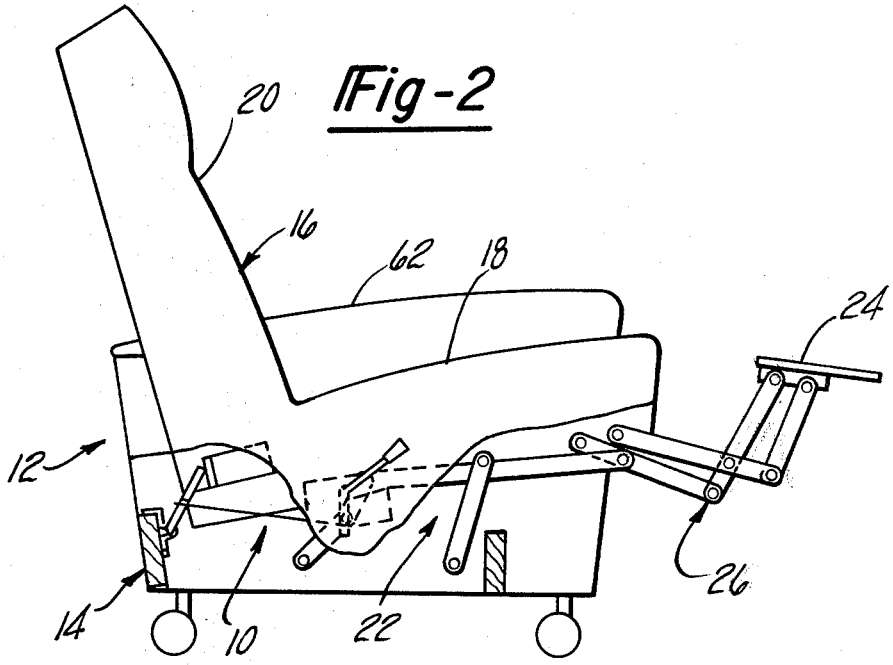
FIG. 2 is a side elevational view of a recliner chair like FIG. 1 but showing the recliner chair in its reclining position.

Referring to the drawing, the reclining actuator assembly of the present invention, indicated generally at 10 in FIG. 1, is installed on a recliner chair 12 consisting of a chair frame 14, a seat unit 16 including a seat 18, a backrest 20 fixedly connected to the seat 18, and a linkage 22 connecting the seat unit 16 to the chair frame 14 for back and forth movement longitudinally of the chair between a seating position, as shown in FIG. 1, where the backrest is generally upright and the seat 18 is generally horizontal and a reclining position, as seen in FIG. 2, where the seat unit 16 is moved forwardly and pivoted slightly rearwardly. The recliner chair 12 also includes a footrest 24 connected to the seat unit 16 and the linkage 22 by a scissors linkage 26. The footrest 24 is movable between a concealed upright position in the seating position of the recliner chair 12, as shown in FIG. 1, and an extended horizontal position in the reclining position of the recliner chair 12 as shown in FIG. 2. A chair of this type is disclosed in U.S. Patent application Ser. No. 100,951, filed on Dec. 6, 1979, the specification of which is incorporated herein by reference.

The reclining actuator assembly 10 is operable to effect a reclining movement of the recliner chair 12 from its upright seating position shown in FIG. 1 toward its reclining position shown in FIG. 2 where the seat unit 16 is positioned forwardly and pivoted rearwardly with respect to its seating position.

Figure 3:
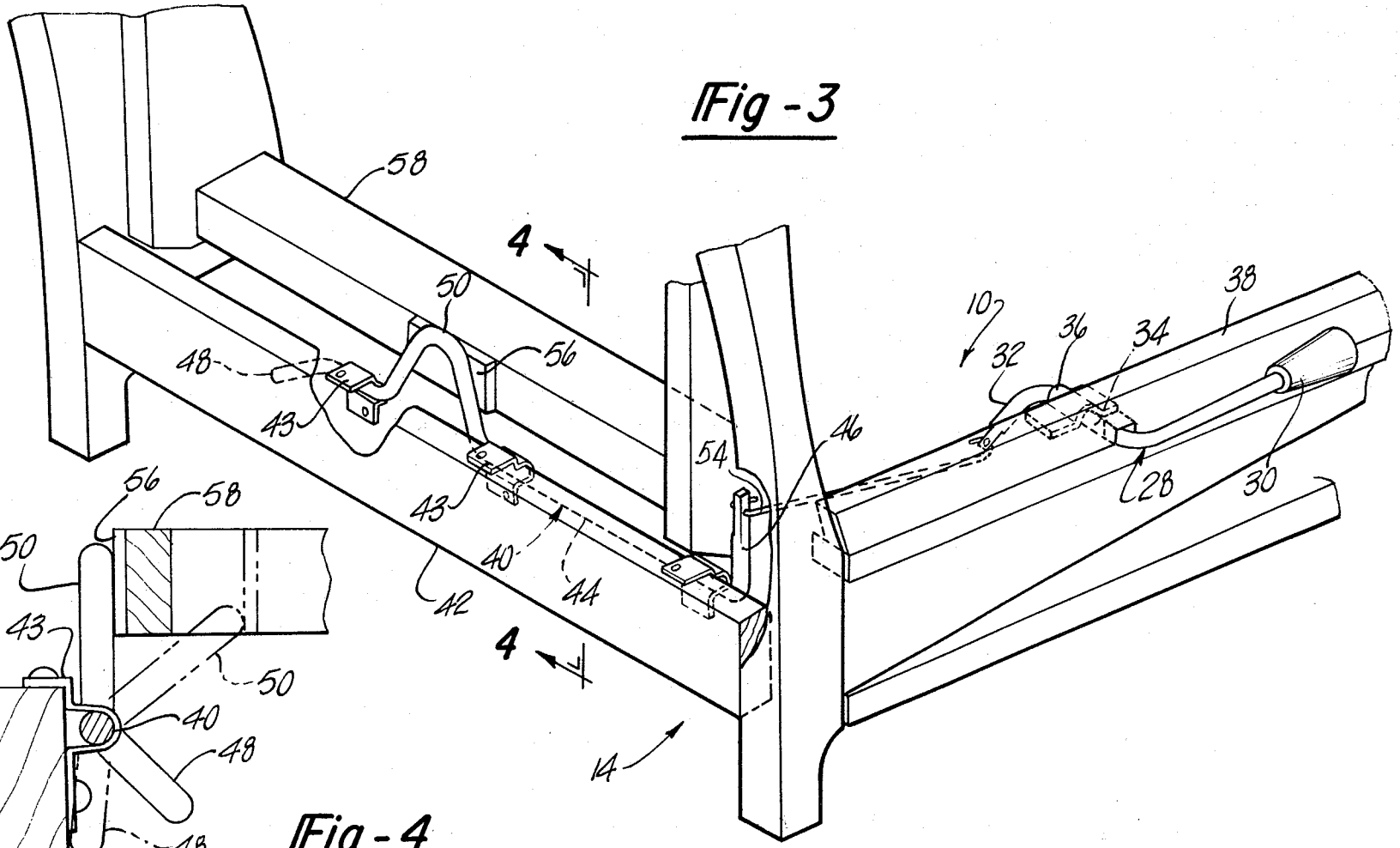
FIG. 3 is a perspective view of a portion of the chair frame and a portion of the seat unit of the recliner chair shown in FIGS. 1 and 2 and illustrating in greater detail the reclining actuator assembly of the present invention.

As shown in FIG. 3, the actuator assembly 10 includes a handle 28 having a gripping portion 30 and an offset portion 32 connected to the gripping portion by a transversely extending connecting bar 34. The handle 28 is pivotally mounted by a bracket 36 on a frame member 38 on one side of the chair frame 14 for pivotal movement about an axis defined by the connecting bar 34 which extends transversely of the chair 12. The gripper portion 30 is longer than the offset portion 32 to provide a force multiplying mechanical advantage when the handle 28 is pivoted.

The reclining actuator assembly 10 includes an activator member 40 pivotally mounted on a transversely extending rear frame member 42 of the chair frame 14 by brackets 43. The activator member 40 includes a main portion 44 having at one end a transversely extending lever arm 46 and at the other end an integral stop extension 48. An abutting portion 50 is integrally formed in the main portion 44 of the activator member 40 intermediate its ends and has a generally U-shaped configuration. The lever arm 46 and the abutting portion 50 which also extends transversely of the main portion 44 are located in a common plane. The stop extension 48 also extends transversely of the main portion 44 but is located at an angle with respect to the lever arm 46 and the abutting portion 50. Its function and configuration will be explained below. The offset portion 32 on the handle 28 is connected to the end of the lever arm 46 by a link member 54 which consists of a heavy gauge wire having hooked or return bent end portions that are inserted into holes formed in the ends of the offset portion 32 and the arm 46.

As shown in FIGS. 1 and 3, the handle 28 is located in an idle position in which the gripper portion 30 extends forwardly from the connecting bar 34 and is only slightly inclined upwardly from the horizontal to allow an occupant of the recliner chair 12 to easily grasp the gripper portion 30 utilizing its initial angular position to exert maximum mechanical force on the handle 28. The handle 28 is moved to a more upright operative position, shown in FIG. 2, to actuate the activator member 40 to move the seat unit 18 from its seating position (FIG. 1) toward its reclining position (FIG. 2). The activator member 40 is pivotal between an upright rest position and an inclined forwardly extending position (FIG. 2) in response to movement of the handle 28 from its idle position toward its operative position. The abutting portion 50 is located in the path of movement of the seat unit 16 and engages a bearing plate 56 mounted on a cross frame member 58 which forms a portion of the seat unit 16.

Figure 4:
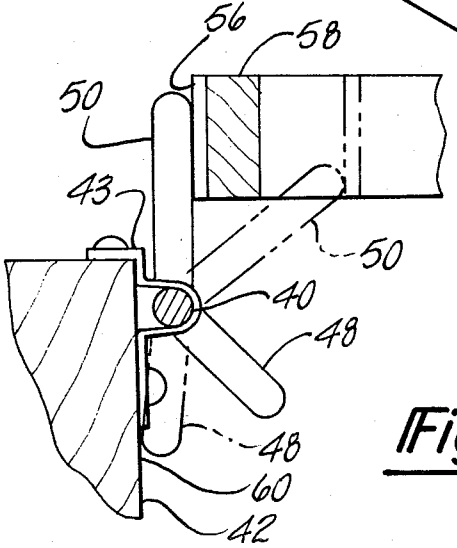
FIG. 4 is a fragmentary sectional view of the recliner chair taken substantially from line 4—4 in FIG. 4.

As shown in FIG. 4, the activator member 40 is pivotal between its upright rest position, shown in solid lines, and a forwardly pivoted inclined position shown in broken lines. The stop extension 48 extends below the main portion 44 of the activator member 40 and forwardly at an angle with respect to the plane in which the abutting portion 50 is located. The stop extension 48 engages the upright forward surface 60 of the cross frame 42 when the activator member is in its activated forward position to restrain further forward pivoting of the activator member 40. Accordingly, the stop extension 48 operates to prevent a further forward pivoting of the activator member 40 thus to maintain the abutting portion 50 in the path of movement of the seat unit 16 generally and, specifically, in the path of movement of the plate 56 mounted on the cross frame member 58 of the seat unit 16.

The reclining actuator assembly 10 is only operable to move the seat unit 16 from the seating position toward its reclining position. Assume that the recliner chair 12 is in the seating position illustrated in FIG. 1. A counterclockwise pivoting of the handle 28 causes a corresponding pivoting of the offset member 32 which through the link member 54 pivots the lever 46 on the activator member 40 forwardly. The abutting portion 50 is moved forwardly through an arc and engages the bearing plate 56 to push the seat unit 16 forwardly toward its reclining position (FIG. 2). Movement of the seat unit 16 toward its reclining position, as shown in FIG. 2, extends the footrest 24 through the action of the linkages 22 and 26. The stop extension 48 prevents a further forward pivoting of the activator member 40 from its activated forward position when it engages the surface 60 on the frame member 42. The seat unit 16 is returned from its reclining position when the occupant grasps the armrests 62 and shifts his weight so as to move the seat unit 16 rearwardly. Because the abutting portion 50 is always maintained in the path of movement of the bearing plate 56, the rearward movement of the seat unit 16 will pivot the activator member 40 rearwardly from its activated position toward its upright rest position. The pivoting of the activator member 40 toward its rest position causes the handle 28 to be pivoted through the link member 54 toward its idle position.

From the above description, it can be seen that an improved reclining actuator assembly 10 is provided which operates only to effect a reclining movement of a reclining chair. The reclining actuator assembly 10 consists of few components, and is easily installed. The reclining actuator assembly 10 is particularly adapted for mounting on a reclining chair since it does not require an integration of its components with any existing linkage connecting the seat unit with the chair frame. The utilization of a pushing force near the center of the chair rear rail 58 to move the chair to its reclining position enables the handle 28 to be moved easily, requiring little force.

It is claimed:

1. In a reclining chair comprising a chair frame, a seat unit, and linkage means mounting said seat unit on said chair frame for back and forth movement between a seating position and a reclining position located forwardly of said seating position, an actuator assembly mounted on said chair frame and operable when actuated to move said seat unit from said seating position toward said reclining position, said actuator assembly comprising a handle mounted on said chair frame movable between an idle position and an operative position, an activator member mounted on said chair frame for movement between a rest position and an activated position, link means connecting said handle with said activator member for transmitting the movement of said handle from said idle position toward said operative position to said activator member to move said activator member from said rest position to said activated position, said activator member being in a non-connected relation with said seat unit and having an abutting portion located in the part of movement of said seat unit so that when said seat unit is in said seating position, movement of said activator member from said rest position toward said activated position in response to movement of said handle from said idle position toward said operative position causes said abutting portion to abut said seat unit and apply a forwardly directed force to said seat unit operable to move said seat unit from said seating position toward said reclining position.

2. The actuator assembly according to claim 1, wherein said actuator assembly is operable only to move said seat unit forwardly from said seating position toward said reclining position.

3. The actuator assembly according to claim 1, wherein said activator member is pivotally mounted on said chair frame with said abutting portion extending upwardly in the rest position of said activator member and extending forwardly in the activated position of said activator member.

4. The actuator assembly according to claim 3, and further including coacting stop means on said activator member and on said chair frame operable to restrain forward pivoting of said activator member from said activated position so as to maintain said abutting portion in the path of movement of said seat unit.

5. The actuator assembly according to claim 4, wherein said coacting stop means comprises an integral extension on said activator member projecting at a selected angle with respect to said abutting portion.

6. The actuator assembly according to claim 1, wherein said activator member comprises a rod member having a longitudinal main portion, a lever arm at one end of said main portion to which said link means is connected, said abutting portion being formed integral with said main portion, said lever arm and said abutting portion extending upwardly when said activator member is in said rest position.

7. The actuator assembly according to claim 6, wherein said activator member includes an integral stop extension extending at a selected angle with respect to said abutting portion.

8. The actuator assembly according to claim 7, wherein said lever arm and said abutting portion are located in common planes and wherein said stop extension is positioned at said selected angle with respect to said planes.

9. A reclining chair comprising a chair frame, a seat unit having a cross frame member, linkage means mounting said seat unit on said chair frame for back and forth movement between a seating position and a reclining position located forwardly of said seating position, and an actuator assembly operable only when activated to move said seat unit from said seating position toward said reclining position, said actuator assembly comprising an activator member pivotally mounted on said chair frame for pivotal movement between a rest position and an activated position, said activator member being in a non-connected relation with said seat unit and including a seat unit abutting portion located in the path of movement of said cross frame member and operable in response to movement of said activator member from said rest position toward said activated position to abut said cross frame member and apply a forwardly directed force to said seat unit operable to move said seat unit from said seating position toward said reclining position.

10. The recliner chair according to claim 9, wherein return movement of said seat unit from said reclining position engages said seat unit engaging portion in the activated position and moves it toward said rest position.

* * * * *